2/10/87 XR 4,642,517

United States Patent [19]

Kanehisa et al.

[11] Patent Number: 4,642,517

[45] Date of Patent: Feb. 10, 1987

[54] IMAGE DISPLAY APPARATUS WITH DEFORMABLE ACCELERATING ELECTRODES

[75] Inventors: Takashi Kanehisa, Osaka; Mitsunori Yokomakura, Takatsuki, both of Japan

[73] Assignee: Matsushita Electric Industrial Co., Ltd., Kadoma, Japan

[21] Appl. No.: 675,392

[22] Filed: Nov. 27, 1984

[30] Foreign Application Priority Data

Nov. 30, 1983 [JP] Japan ..... 58-225916

[51] Int. Cl.[4] ..... H01J 31/20; H01J 63/02

[52] U.S. Cl. ..... 313/495; 313/422

[58] Field of Search ..... 313/495, 422; 358/56

[56] References Cited

U.S. PATENT DOCUMENTS 4,449,148 5/1984 Inohara et al. ..... 313/422 X

*Primary Examiner*—Palmer C. DeMeo

*Attorney, Agent, or Firm*—Wenderoth, Lind & Ponack

[57] ABSTRACT

An image display apparatus provided with wire electron sources, electron beam control electrodes for controlling the electron beam emitted from the electron sources, electron beam deflecting electrodes for deflecting the electron beam, electron beam accelerating electrodes an electron beam light-emitter which emits light when struck by an electron beam, and an evacuated enclosure having a transparent face at which the light-emitter is positioned and enclosing the electron source and electrodes, at least the electron beam accelerating electrodes being electrodes which are adapted to be deformed when subjected to a Coulomb force to a predetermined beam position, thereby eliminating the adverse effect on the image due to deformation of electrodes cause by the Coulomb force generated when each electrode has a voltage applied thereto.

5 Claims, 13 Drawing Figures

IMAGE DISPLAY APPARATUS WITH DEFORMABLE ACCELERATING ELECTRODES

TECHNICAL FIELD

This invention relates to a plane image display apparatus of an image display equipment, and more particularly to an image display apparatus electrode construction for an improvement in the accuracy with which the electron beam strikes the face of the tube to provide an image display of higher quality.

BACKGROUND ART

Referring to FIG. 1, an example there is shown of the basic structure of an image display element according to the prior art.

The display element comprises a back electrode 1, horizontal wire cathodes 2 as the electron beam source, vertical focusing electrodes 3, 4 and 5, vertical deflection electrodes 6, electron beam control electrodes 7, horizontal focusing electrodes 8 and 9, horizontal deflection electrode 10, electron beam accelerating electrodes 11, and a screen plate 12, which parts are disposed from the back to the front in the recited order and housed in a flat vacuum glass tube (not shown).

The plurality of wire cathodes 2 serving as the electron beam source are spaced vertically (in the direction of the arrow Y) and spaced at proper intervals, only three wire cathodes 2*a* to 2*c* being shown. This example, however, will be described assuming that in the actual device fifteen wire cathodes are provided. The wire cathodes 2 are so controlled that an electron beam is emitted from each cathode 2 for a predetermined time in order beginning with the uppermost wire cathode 2*a*. The back electrode 1 produces a potential gradient between the vertical focusing electrode 3 and the back electrode 1, suppresses generation of electron beams from wire cathodes other than the wire cathode 2 controlled to emit the electron beam for a predetermined time, and functions to push the emitted electron beam frontward only. The vertical focusing electrode 3 is an electrically conductive plate having a number of through holes 13 opposite the respective wire cathodes 2 and juxtaposed horizontally at small intervals (nearly joined with each other), and passes through the through holes 13 the electron beams emitted from the wire cathodes 2 so as to focus them vertically, the vertical focusing electrodes 4 and 5 functioning the same as the electrode 3.

The plurality of vertical deflection electrodes 6 are disposed horizontally from intermediate portions between the lines of through holes 13 and each comprise an insulating substrate 15 provided on the upper and lower surfaces with conductors 16 and 16', the conductors 16 and 16' opposed across the space therebetween having applied thereacross a deflecting voltage to vertically deflect the electron beams. In this structural example, the pair of conductors 16 and 16' deflect the electron beam from one wire cathode 2 vertically and toward one of sixteen line positions, the sixteen vertical deflection electrodes 6 constituting fifteen pairs of conductors corresponding to fifteen wire cathodes 2 respectively. In all, the electron beams are deflected so as to describe 240 horizontal lines on the screen 12.

Next, the control electrodes 7 each pass the electron beams horizontally and separately for each picture element and control the quantity passed in accordance with video signals for displaying the picture elements respectively. Accordingly, when 320 control electrodes 7 are provided, 320 picture elements per one horizontal line can be displayed. Also, for color display of an image, the picture elements are to be displayed by fluorescent materials of three colors, namely of red, green and blue respectively, the respective control electrodes 7 being given the video signals for red, green and blue. Also, 320 sets of images are applied simultaneously and the images on one line are displayed at one time. The horizontal focusing electrode 8 comprises a conductive plate 17 having a number of through holes (not shown, but the same in shape as through holes 18 in the horizontal focusing electrode 9) opposite to the slits in the control electrodes 7 respectively, extending vertically (in the direction of the arrow Y), and juxtaposed horizontally at narrow intervals to thereby horizontally focus the electron beam at every picture element horizontally separate from each other so that the electron beam becomes thin, the horizontal focusing electrode 9 being the same as that 8.

The horizontal deflection electrode 10 comprises a plurality of conductive plates 19 disposed vertically and corresponding to an intermediate portion between the respective through bores at the horizontal focusing electrode 8 so that horizontal deflecting voltage is applied between the respective conductive plates 19 to horizontally deflect the electron beam for each picture element and allow the respective fluorescent materials of R.G. and B. to emit light under sequential irradiation, the deflection range in this example corresponding to the width of one picture element per each electron beam.

The accelerating electrodes 11 comprise a plurality of conductive ribbons 20 one provided at the position corresponding to each vertical deflection electrode 6 and directed widthwise horizontally, and which accelerate the electron beams to cause them to hit the screen 12 with sufficient energy and serves supplementarily to deflect the electron beam vertically.

The screen 12 is provided with fluorescent materials 21 which are made luminous by irradiation of electron beams, in other words, a set of fluorescent materials of three colors, red, green and blue, are provided with respect to each electron beam horizontally divided at one slit at the control electrode 7, and these materials are coated in vertical stripes on screen 12. In FIG. 1, the two-dot chain lines on the screen 12 divide the screen 12 vertically corresponding to the respective wire cathodes 2 and the broken lines show the boundaries of horizontal divisions divided corresponding to the plurality of control electrodes 7. One section partitioned by both the boundary lines contains the fluorescent material 21 extending horizontally corresponding to one picture element of R, G and B and vertically a width of sixteen lines, and is sized to be 1 mm long horizontally and 1 mm long vertically. In this example, only one set of fluorescent materials 21 of R, G and B are provided with respect to one picture element, but alternatively two or more sets of the same corresponding to two or more picture elements may be used. In this case, the control electrodes 7 are sequentially given video signals of R, G, and B for two or more picture elements and simultaneously subjected to the horizontal deflection.

In such construction, however, when voltage is applied to each electrode, especially the conductive ribbons forming the accelerating electrodes 11, when the voltage is a high voltage, the electrodes are pulled by a Coulomb force toward the horizontal focusing electrode 9 which leads to distortion as shown by the broken lines in FIG. 2. As a result, each accelerating electrode 11 has a vertical (in the direction of the arrow Y) deflection sensitivity which is different at the central portion from that at both lengthwise ends. Hence, the electron beam is deflected vertically more largely at the central portion than both the ends of each accelerating electrode 11 so that the electron beams are overlapped at a porton (hatched in FIG. 3) at both sides of the boundary between the regions on the screen 12 alloted to the individual wire cathodes, e.g. the cathodes 2*a* and 2*b*. Hence, the brightness at the overlapped portion is more intense than the where the beams are not overlapped and a horizontal stripe appears on the image, thereby causing a large defect in the image display apparatus.

SUMMARY OF THE INVENTION

An object of the invention is to provide an image display apparatus provided with electrodes including accelerating electrodes, which when deformed when subjected to the Coulomb force nevertheless hold the predetermined position of the electron beam, thereby eliminating the adverse effect caused by deformation of each electrode due to the Coulomb force when each electrode is supplied with a voltage, thus obtaining very beautiful images free from the horizontal stripes.

The above and further objects of the invention will more fully appear from the following detailed description when the same is read in connection with the accompanying drawings.

BEST MODE FOR CARRYING OUT THE INVENTION

Figure 4:
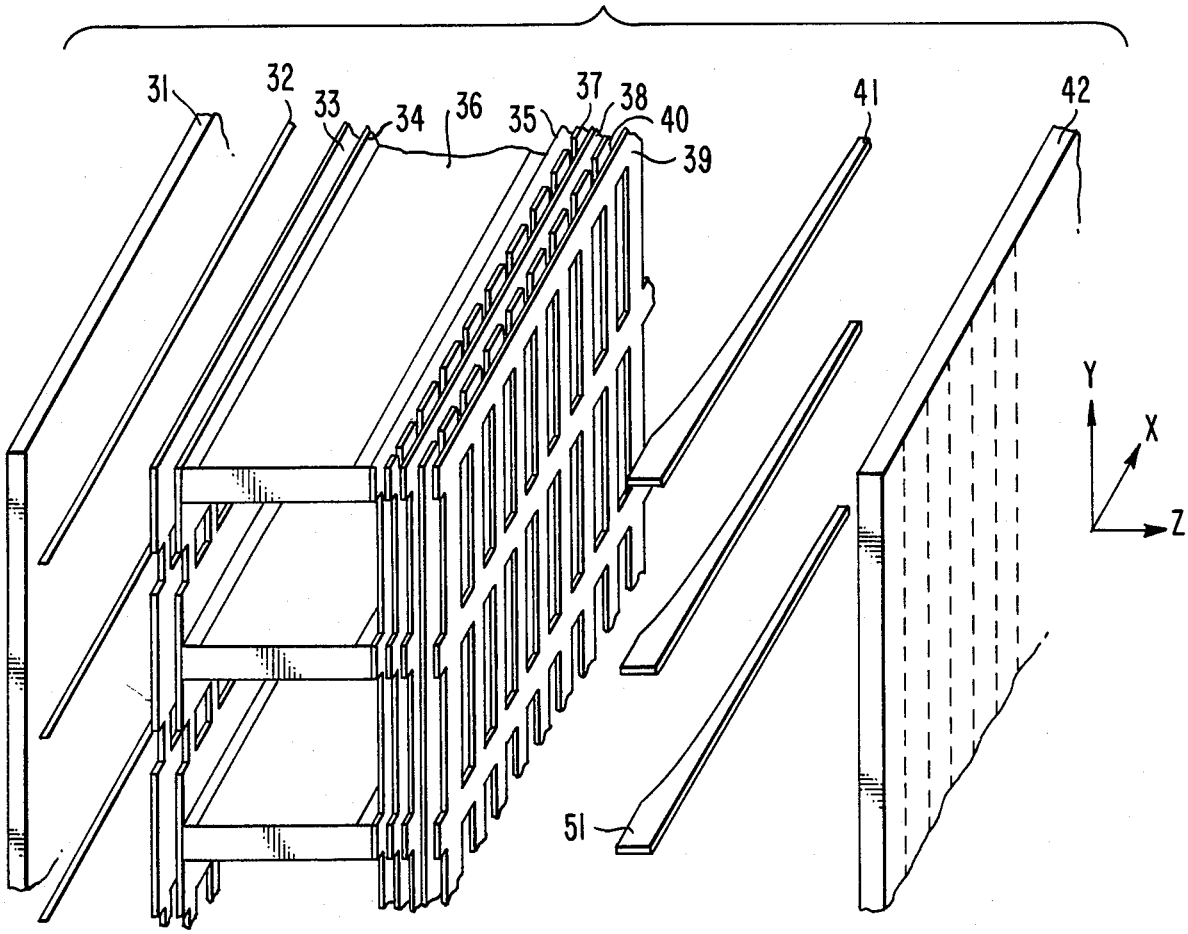
FIG. 4 is an exploded perspective view of an image display element according to an embodiment of the image display apparatus of the invention, FIG. 5(*a*) is a perspective view of a conventional accelerating electrode, FIGS. 5(*b*) and 5(*c*) are perspective views of accelerating electrodes used in the embodiment of the invention, FIGS. 6(*a*) and 6(*b*) are side views of conductive ribbons of the prior art and the present invention in deformed condition before and after being subjected to the Coulomb force.

An embodiment of the image display apparatus of the invention will be described with reference to FIGS. 4 to 8. In FIG. 4, a back electrode 31, wire cathodes 32, vertical focusing electrodes 33, 34 and 35, vertical deflection electrodes 36, electron beam control electrodes 37, horizontal focusing electrodes 38 and 39, a horizontal deflection electrode 30, electron beam accelerating electrodes 41 and a screen plate 42, are disposed from back to front in the recited order and housed in a vacuum glass container (not shown). Each electron beam accelerating electrode 41 comprises a conductive ribbon 51 or 52 shown in FIGS. 5(*b*) and 5(*c*), which is inwardly curved at one side or both sides and stretched under tension across a frame (not shown), the curved ribbon 51 or 52 having a curvature R of 50,000 to 60,000 mm and being subjected to tension of about 900 gr. per electrode, R being determined from the quantity of deformation by the Coulomb force to which the electrodes are subjected when the electrodes have a voltage applied thereto. Therefore, each electrode, when a voltage is applied thereto, especially each accelerating electrode 41 when a high voltage is applied thereto, is pulled by the Coulomb force toward the horizontal focusing electrode 39 and deformed.

Figure 1:
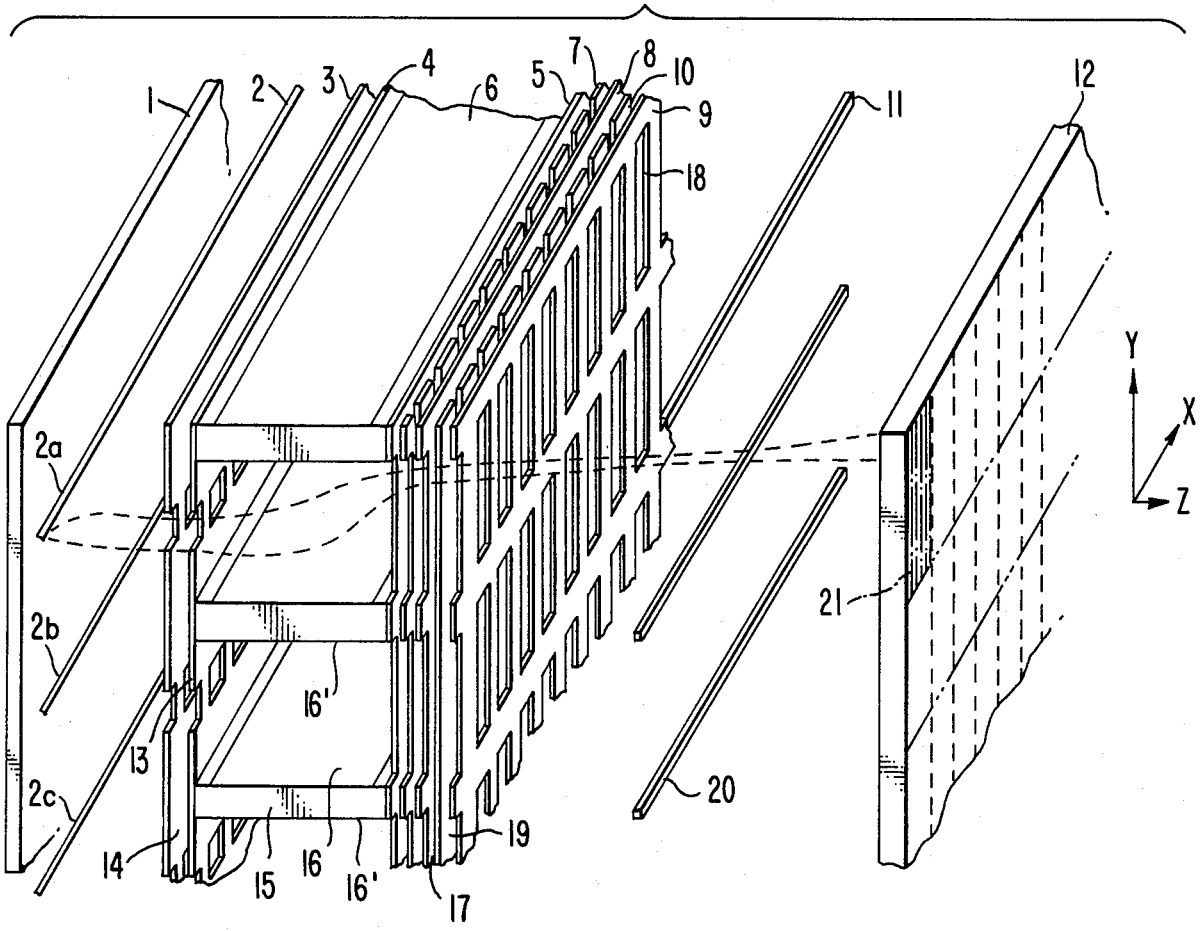
FIG. 1. (PRIOR ART)
FIGS. 1 and 2 are perspective exploded views showing the basic construction of an image display element used for a conventional image display apparatus.
Figure 7:
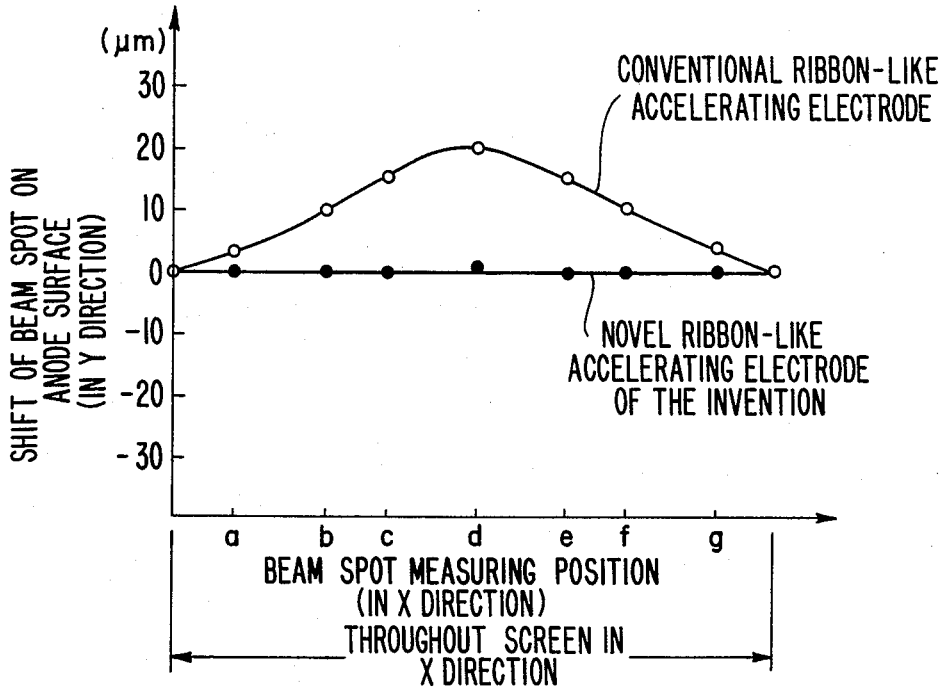
FIG. 7 is a graph representing the effect of the embodiment of the invention, and FIGS. 8(*a*)–8(*c*) are perspective views of modified forms of accelerating electrodes according to the invention.
Figure 2:
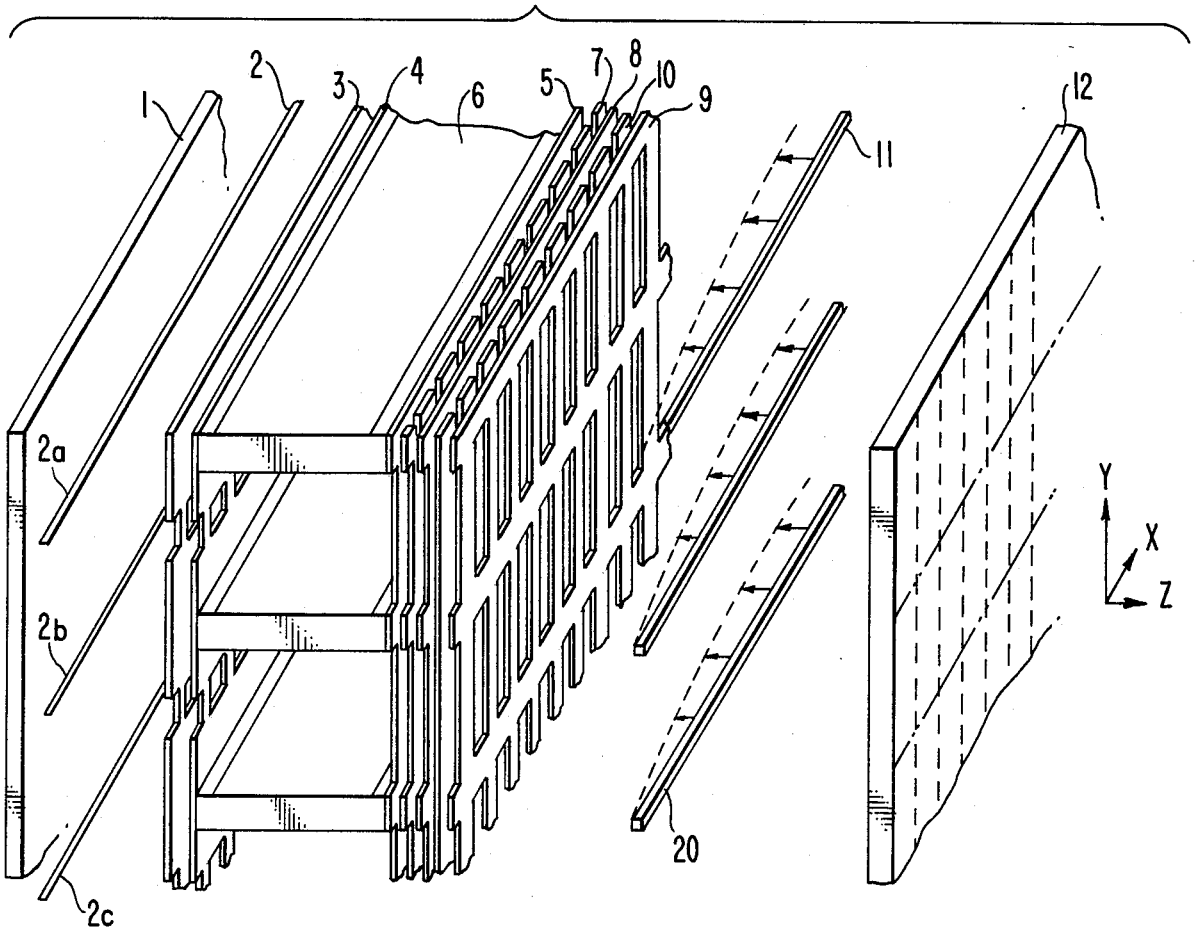
FIG. 2. (PRIOR ART)
Figure 3:
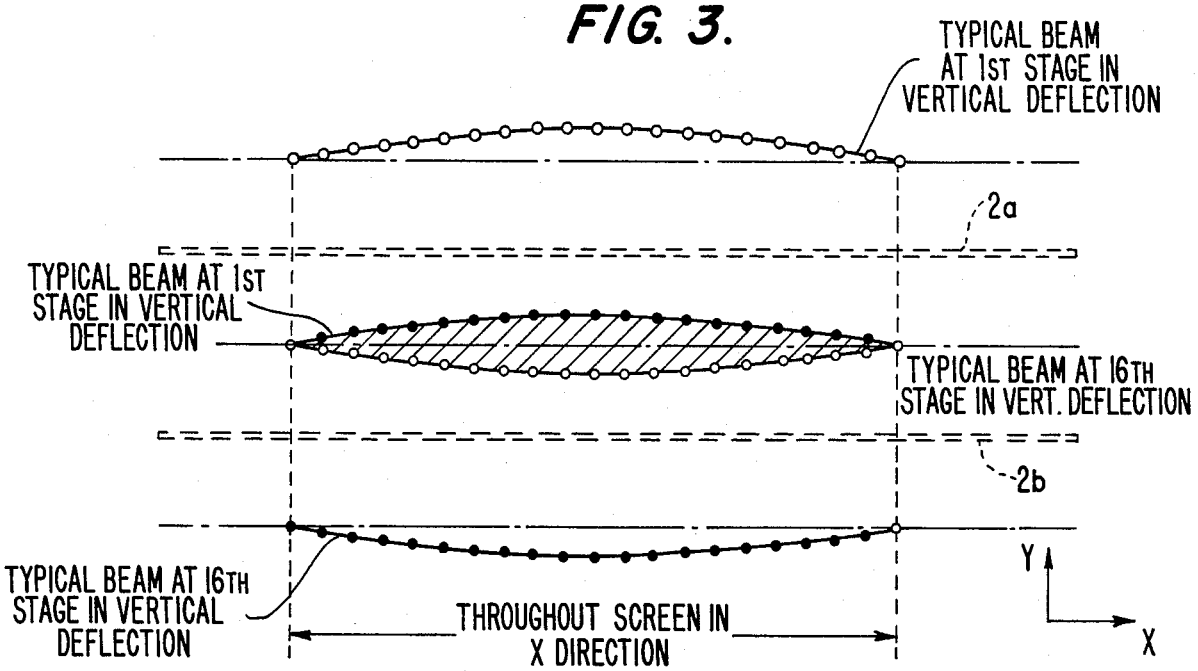
FIG. 3 is a diagram showing the linearity of vertical deflection of an electron beam when accelerating electrodes are deformed.
Figure 6A:
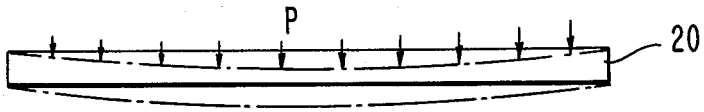
FIG. 6(a). (PRIOR ART)
Figure 6B:
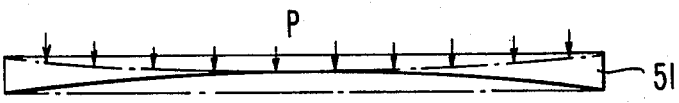
FIG. 6(b). (PRIOR ART)
Figure 5A:
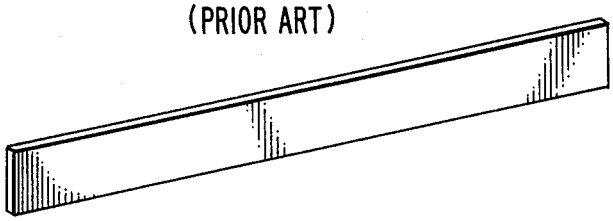
FIG. 5(a). (PRIOR ART)
Figure 5B:
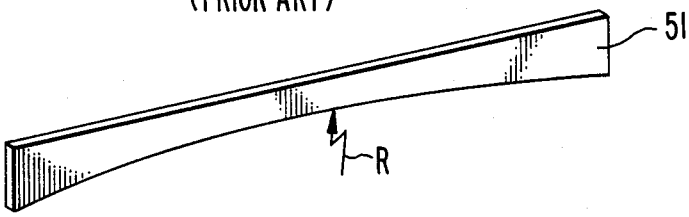
FIG. 5(b). (PRIOR ART)
Figure 5C:
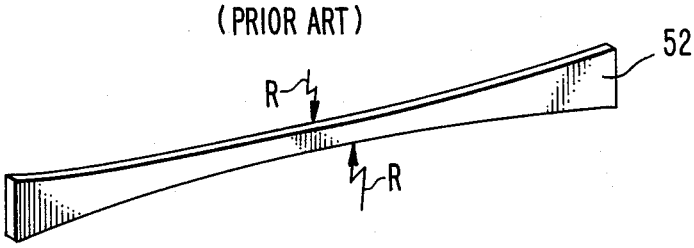
FIG. 5(c). (PRIOR ART)

Referring to FIGS. 6(*a*) and 6(*b*), the conventional conductive ribbon 20 and the conductive ribbon 51 of the embodiment of the invention are shown in condition before and after being acted on by the Coulomb force, the conductive ribbon 51 being deformed as shown by the two-dot chain line in FIG. 6(*b*) so as to be in the predetermined position. As a result, the linearity of a typical electron beam at the first stage of vertical deflection alloted to the wire cathode 2*a* shown in FIG. 3 is shown by the black spots in FIG. 7, thereby enabling the horizontal stripe to be eliminated.

Figure 8A:
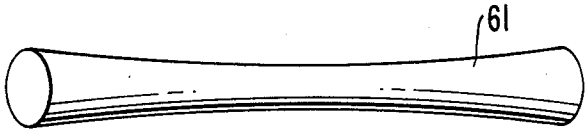
Figure 8B:
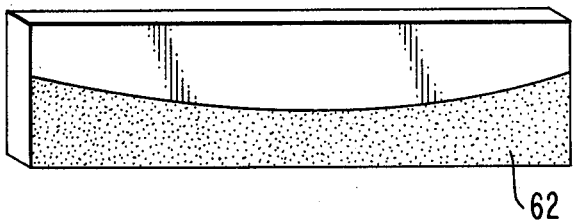
Figure 8C:
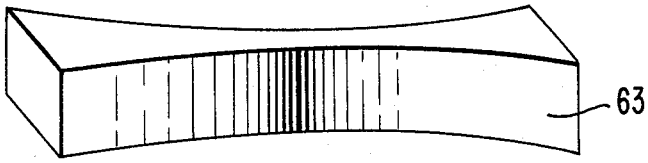

Alternatively, electrodes of various shapes, as shown in FIGS. 8(*a*) to 8(*c*), can be used for the accelerating electrode 41. In FIG. 8(*a*) an electrode 61 is used for the accelerating electrode is wire-like-shaped, having the smallest diameter at the lengthwise central portion and being larger at both ends. Electrode 62 is usuable for the accelerating electrode and is formed of an electrode portion (the hatched portion) attached to an insulating substrate, the electrode portion being curved inwardly at one side. Also, electrode 63 is usable for the accelerating electrode, having a smaller thickness in the middle thereof, and being deformed thicknesswise so as to be in the desired predetermined position.

As seen from the above, the image display apparatus of the invention comprises the respective electrodes including the accelerating electrodes, which, when subjected to the Coulomb force, are deformed to the predetermined beam position, thereby enabling elimination of the adverse effect on the images caused by the Coulomb force, thus obtaining an image display apparatus of high quality.

While a preferred embodiment of the invention has been described using specific terms, such description is for illustrative purposes only, and and it is to be understood that changes and variations may be made without departing from the spirit or scope of the following claims.

What is claimed is:

1. An image display apparatus comprising: an elongated wire-like electron source; electron beam focusing and control electrodes positioned in front of said electron source for focusing and controlling electron beams emitted from said electron beam source; electron beam deflection electrodes positioned among said electron beam focusing and control electrodes for deflecting the electron beams; electron beam accelerating electrodes positioned in front of said electron beam focusing, control, and deflection electrodes for accelerating said electron beams;

an electron beam light-emitting means having fluorescent material which emits red, green and blue light when struck by the electron beams; and an evacuated enclosure enclosing said electron source and said electrodes and having a transparent screen adjacent said light-emitting means which is vertically divided into a plurality of sections and horizontally divided into a plurality of sections, said electrodes being operable to direct the electron beams to each section from said wire-like electron source and to vertically deflect an electron beam on each section to display a plurality of lines and to cause the fluorescent material to emit red, green and blue in each section in order, so that the quantity of irradiation of said electron beams on said fluorescent material is controlled; said electron beam accelerating electrodes being deformable and each having an elongated shape which has a side facing toward said electron beam deflection electrodes and a side facing away from said electron beam deflection electrodes for, when subjected to the Coulomb force due to voltages applied to said electrodes, being deformed to bring the side facing toward said electron beam deflection electrodes to a predetermined position of the beams in which the adverse effect on the image due to the deformation of said electron beam accelerating electrodes caused by the Coulomb force generated when each of said electrodes has a voltage applied thereto, is eliminated.

2.

An image display apparatus as claimed in claim 1 in which said electron beam accelerating electrodes are each constituted by an electrically conductive strip curved concavely at least on the side facing toward said deflecting electrodes.

3. An image display apparatus as claimed in claim 2 in which said electron beam accelerating electrodes are conductive ribbons.

4. An image display apparatus as claimed in claim 2 in which said electron beam accelerating electrodes are each also concavely curved on the side facing away from said deflecting electrodes.

5. An image display apparatus as claimed in claim 2 in which said electron beam accelerating electrodes are each a wire shaped strip.

* * * * *